US007017468B2

(12) United States Patent
Steffen

(10) Patent No.: US 7,017,468 B2
(45) Date of Patent: Mar. 28, 2006

(54) PNEUMATIC PIVOTING DEVICE

(75) Inventor: Josef Steffen, Altbüron (CH)

(73) Assignee: Prospective Concepts AG, Glattbrugg (CH)

( * ) Notice: Subject to any disclaimer, the term of this patent is extended or adjusted under 35 U.S.C. 154(b) by 0 days.

(21) Appl. No.: 10/487,328

(22) PCT Filed: Jul. 8, 2002

(86) PCT No.: PCT/CH02/00370

§ 371 (c)(1),
(2), (4) Date: Apr. 9, 2004

(87) PCT Pub. No.: WO03/024280

PCT Pub. Date: Mar. 27, 2003

(65) Prior Publication Data

US 2004/0232754 A1 Nov. 25, 2004

(30) Foreign Application Priority Data

Sep. 19, 2001 (CH) ..... 1727/01

(51) Int. Cl.
*F15B 15/26* (2006.01)

(52) U.S. Cl. ..... 91/41; 92/37; 92/92

(58) Field of Classification Search ..... 91/41; 92/35, 37, 39, 44, 48, 92; 5/615
See application file for complete search history.

(56) References Cited

U.S. PATENT DOCUMENTS

| | | | | | |
|---|---|---|---|---|---|
| 2,086,249 | A | * | 7/1937 | Winchell | 92/37 |
| 3,202,061 | A | * | 8/1965 | Johnston | 92/37 |
| 3,495,502 | A | * | 2/1970 | Bousso | 92/39 |
| 5,345,630 | A | * | 9/1994 | Healy | 5/615 |
| 5,416,939 | A | * | 5/1995 | Maalouli | 5/615 |
| 5,572,933 | A | * | 11/1996 | Thompson | 5/615 |

* cited by examiner

*Primary Examiner*—Thomas E. Lazo
(74) *Attorney, Agent, or Firm*—Jenken & Gilchrist, P.C.

(57) ABSTRACT

A pneumatic device for pivoting a pivotal component is articulated to a structural element by means of a joint. Hoses produced from a material of low ductility, to which compressed air can be admitted, are inserted between the pivotal component and the structural element. The hoses contain an airtight bag. When these bags are inflated via valves, compressive forces act both on the structural element and on the pivotal component, causing the latter to swivel out. In order that the hoses cannot migrate, webs run from the joint to the hoses. In order to relieve the hoses in a specific limit position of the pivotal component and to prevent oscillatory movements of the pivotal component, a locking device is provided. The locking device includes a rod, which runs through a brake device fixed to an arm.

15 Claims, 4 Drawing Sheets

PNEUMATIC PIVOTING DEVICE

Figure 1:
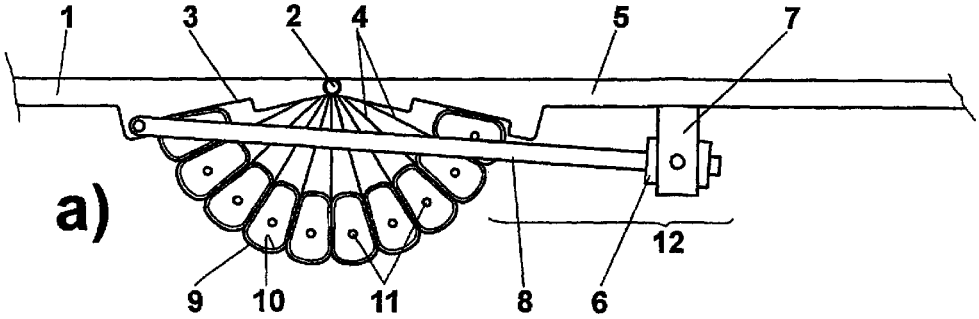

The present invention relates to a pneumatically actuated pivot device according to the pre-characterizing clause of claim 1. Such pivot devices are disclosed, for example, by U.S. Pat. No. 4,865,388 (D1) and DE 35 14040 (D2).

D1 describes a pivoted part in the form of a headrest of a motor vehicle seat. A plurality of pockets that can be inflated by means of compressed air are arranged between the pivotal head rest part and a projecting extension of the backrest of the seat. When compressed air is admitted, the compressive forces exert a torque on the head rest part and bring it upright.

The proposed solution has the disadvantage that minor repelling forces generally act on the headrest and consequently the air pressure is small. Subjected to the repelling forces and the weight of the head resting thereon, the device thereby forms a pneumatic spring with little hardness and a correspondingly low oscillation frequency. A further disadvantage is the large quantity of air required, which when evacuating the inflatable pockets must be expelled again.

The device according to D2 is a pneumatically controlled headrest of a bed. A bellows is arranged between two plates pivotally fixed to one another, so that with increasing pressure in the bellows the upper body of a recumbent person is raised.

The solution according to D2 has the disadvantage, that the bellows has a very large volume and consequently a lot of air is needed in order to pivot the device. In a variant of the device, the bellows takes the form of a column extending under pressure. Although this design variant requires somewhat less pressure medium, under the prevailing torques it is unstable since the bellows has a tendency to buckle.

The object of the present invention is to create a pneumatically operated pivot device which overcomes the said disadvantages and has many different uses as a component.

The object is achieved by the following solution, the essential features of which are presented in the characterizing part of claim 1 and further advantageous developments of which are given in the following claims.

Figure 2:
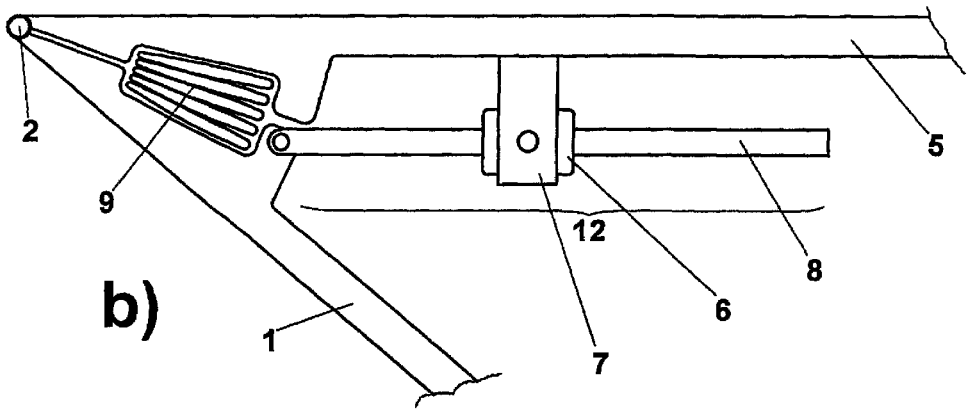
Figure 2:
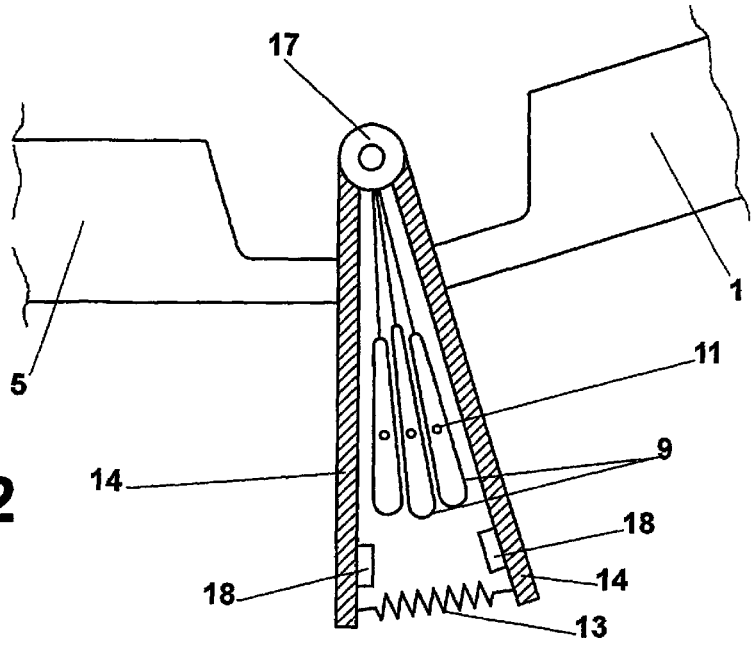
Figure 3:
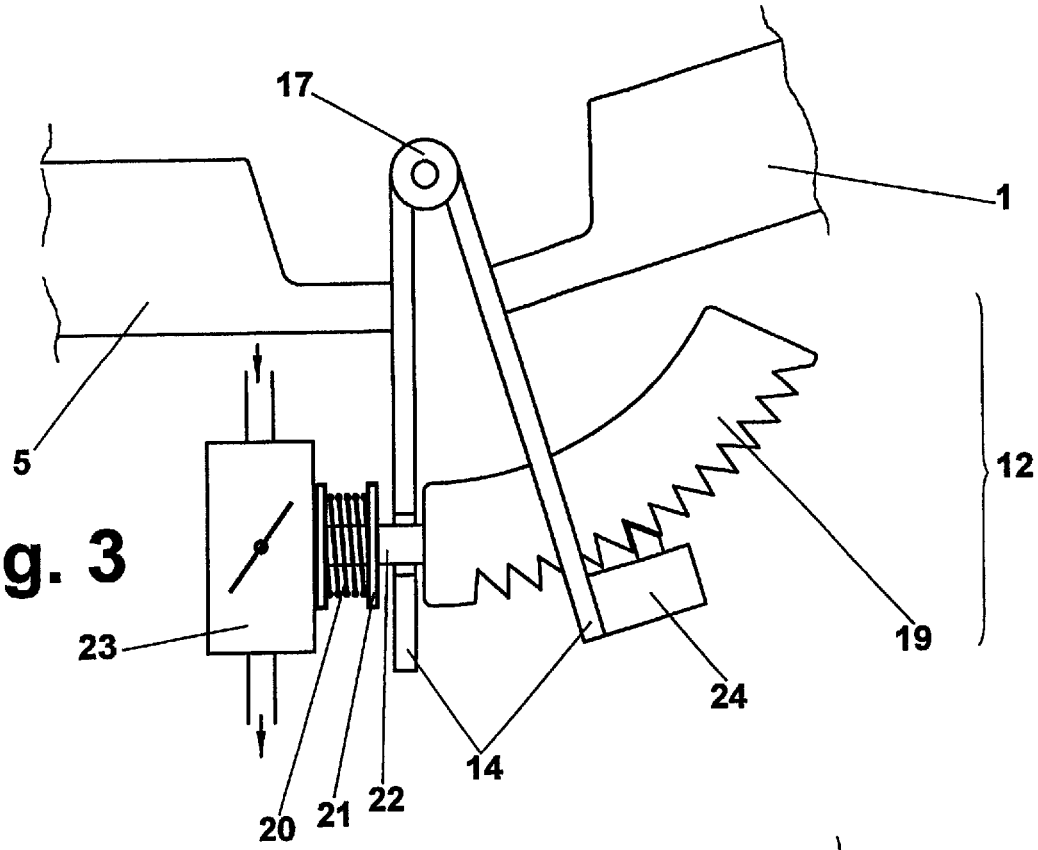
Figure 4:
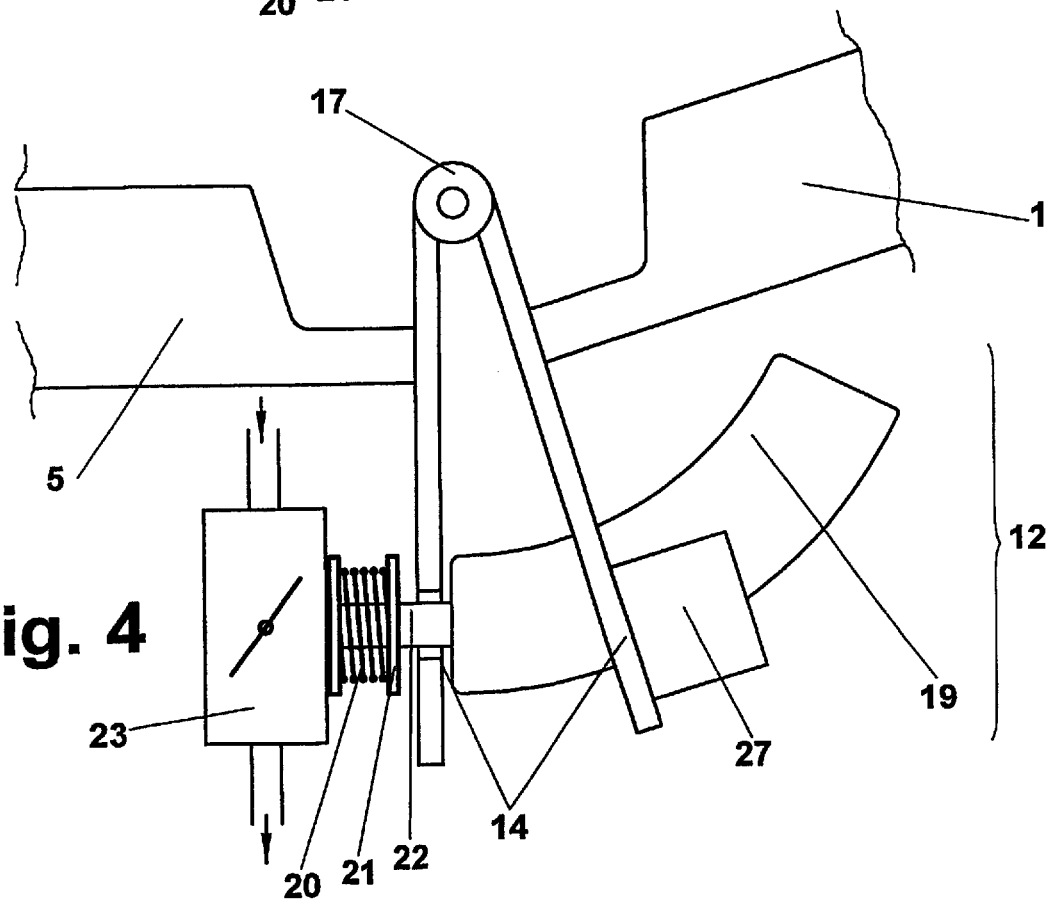
Figure 5:
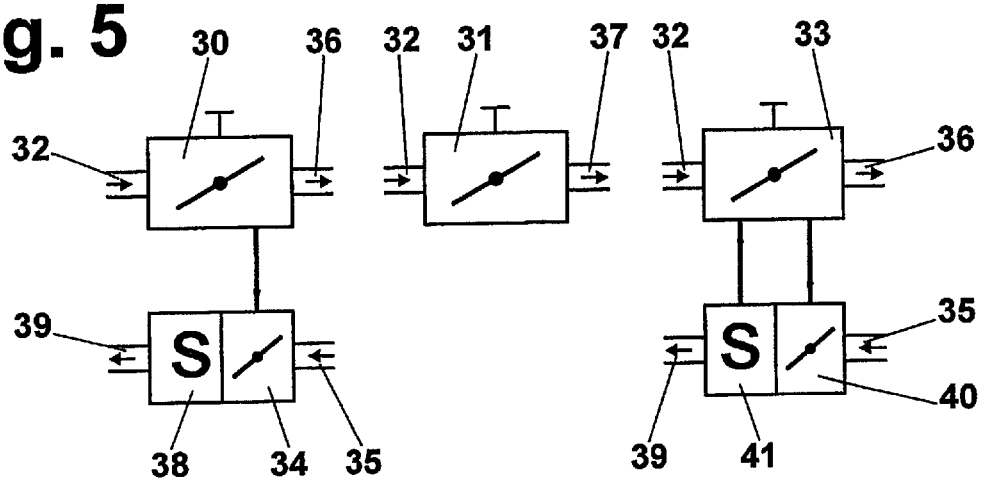
Figure 6:
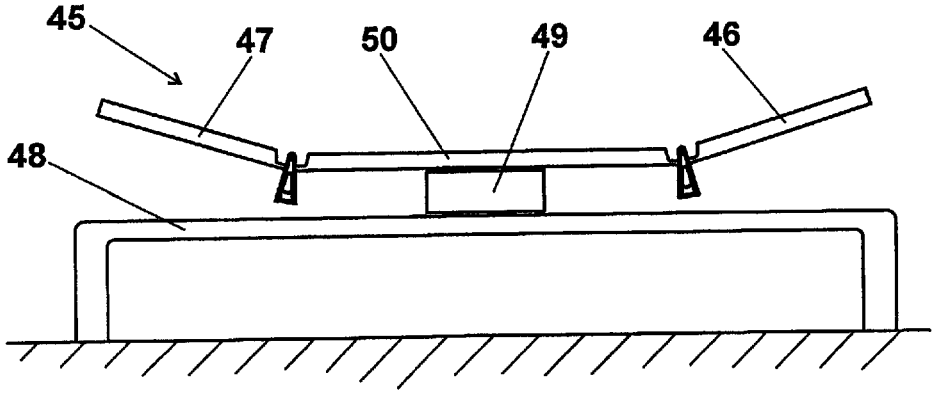
Figure 7B:
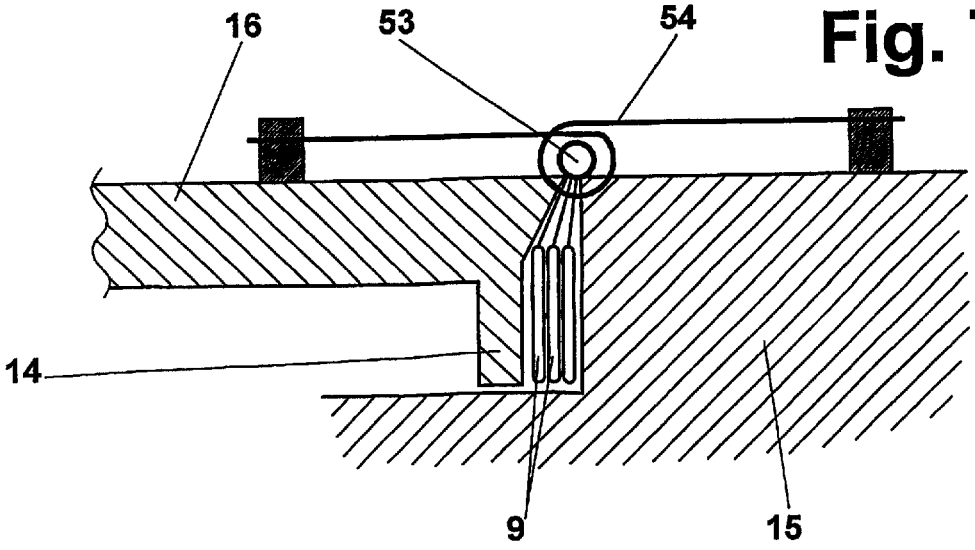
Figure 7A:
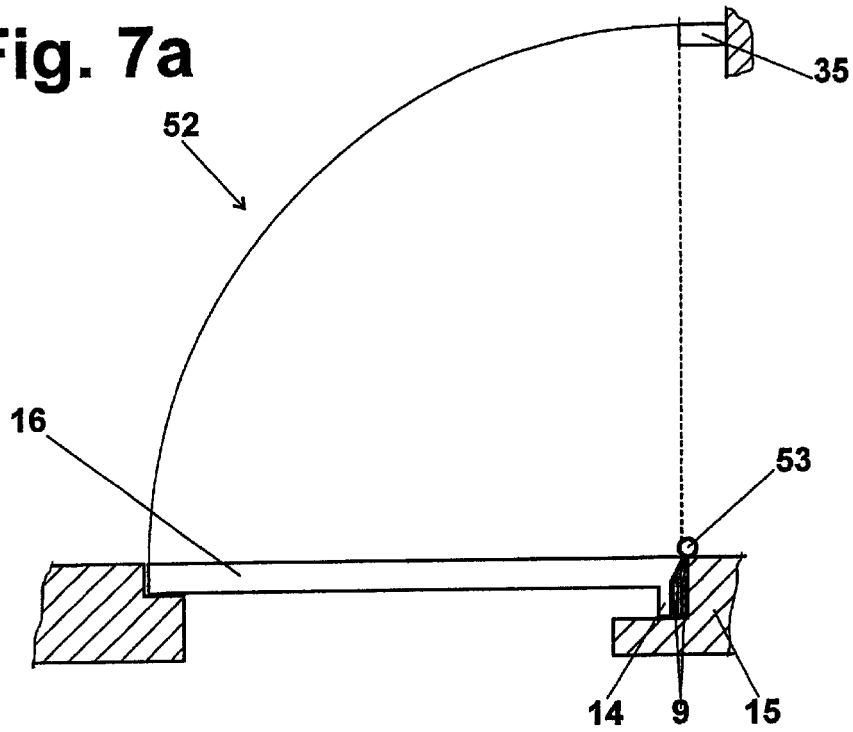

A number of developments of the invention are described in more detail with reference to the drawing attached, in which:

FIGS. 1*a, b* shows a schematic representation of a first example of an application in two positions, constructed from a first exemplary embodiment having a first locking device, FIG. 2 a schematic representation of a second exemplary embodiment, FIG. 3 a representation of a second locking device, FIG. 4 a representation of a third locking device, FIG. 5 an arrangement of control valves according to the invention for the operation of the exemplary embodiments according to FIGS. 1, 2, FIG. 6 a schematic representation of a second example of an application, FIG. 7*a* a schematic representation of a third example of an application, FIG. 7*b* a detail from FIG. 7*a,*

Figure 8:
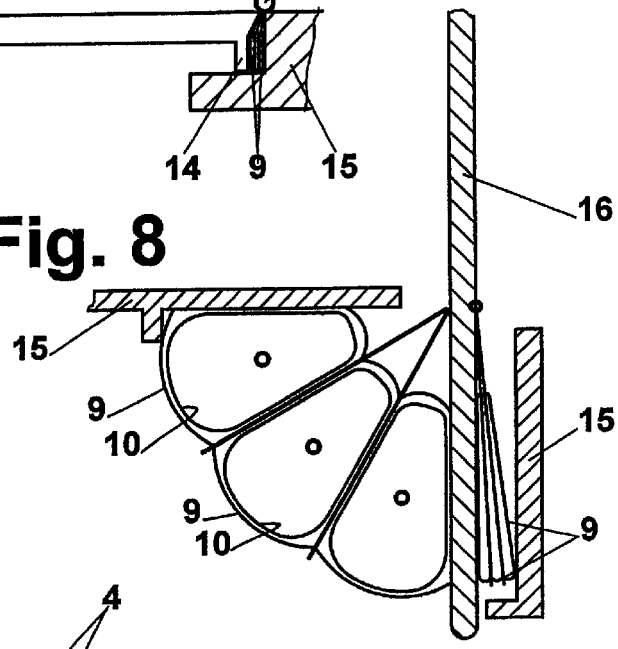

FIG. 8 a variant application to FIGS. 7*a, b,*

Figure 9:
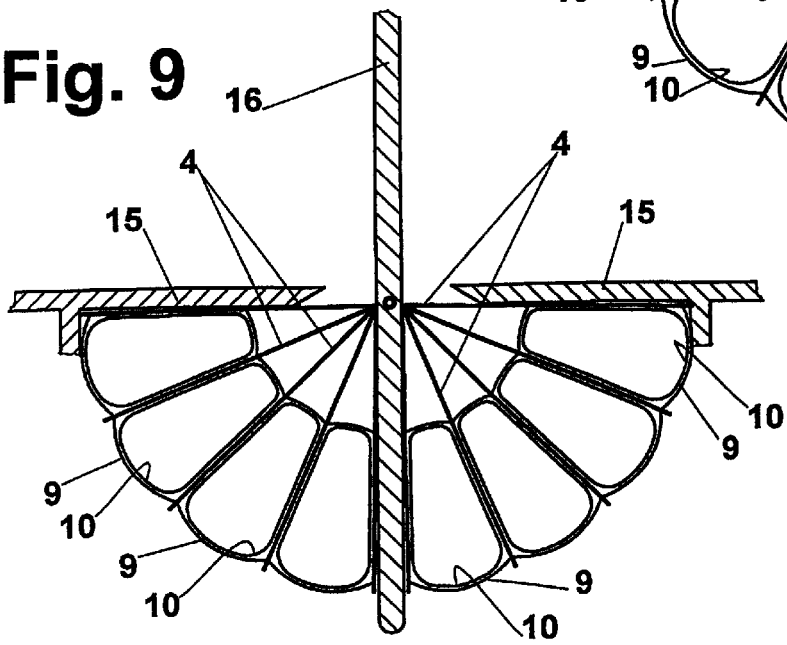

FIG. 9 an extension of the variant application according to FIG. 8.

FIGS. 1*a, b* shows a pivotal component 1, which is designed as footrest of a seat, for example of an aircraft seat; FIG. 1*a* in the retracted position, FIG. 1*b* in the unfolded position. Both show only a schematic representation of the actual support structure without any upholstery. A pivotal component 1, the actual footrest, is pivotally fixed to a structural element 5, here represented by the seat surface—or the support structure thereof—for example by means of a hinged joint 2. Both the seat surface and the footrest each have a mounting surface 3, the surfaces being designed so that they can accommodate a set of hoses 9, without squashing these. The hoses 9 are made of a textile material having a low ductility. Inside they each carry an airtight bag 10 made from an elastic plastic material. As an alternative to this arrangement, the textile hoses 9 may also have an airtight coating, in which case the bags 10 are omitted.

Between each two hoses 9, a web 4 of textile material, for example, extends to the hinged joint 2, where it is suitably fixed. These textile webs 4 prevent the hoses 9 from migrating and in the operation of the pivot device are subjected to tensile loading. The textile webs 4 furthermore greatly reduce the volume of pressure medium, usually air, in the hoses 9, since the space between the hoses 9 and the hinged joint 2, which the textile webs acting like a fan serve to fill, does not need to be subjected to pressure. The hoses 9 are each filled and drained of pressure medium by a valve 11.

The pressurized hoses 9 deploy in a curved shape. In the case of large pivot angles, this arrangement leads to a better pressure-travel ratio than in constructions having only one hose 9, since a virtually full hose 9 does not vary much any more in volume or diameter despite relatively large changes in pressure.

FIG. 1 also shows a first locking device, in which a bar 8 is articulated to the footrest and runs through a first brake device 6, which is pivotally supported on an arm 7 fixed to the seat surface 5.

The operation of the footrest can be controlled by a valve arrangement according to FIG. 5. Not shown in FIGS. 1*a, b* is a spring element, similar to the spring element 13 in FIG. 2, which provides for minimum loading of footrest 1 and ensures complete retraction thereof.

FIG. 2 shows a second exemplary embodiment of a pivot device according to the invention. A pivotal component 1 is pivoted to a structural element 5 in such a way that both the structural element 5 and the pivotal component 1 each carry a plate 14 arranged essentially at 90° to the said parts 1, 5, the said plates being connected to one another over the entire length, for example, by a hinged joint 17. The plates 14 each carry a stop 18. These stops 18 are adjusted so that a specific, intended clearance remains between the two plates 14 when the parts 1, 5 are in the extended position. In the gap between the plates 14 the hoses 9 are inserted, again running along these plates 14. The two plates 14 are connected by a spring element 13, here represented schematically as a tension spring. Obviously, any suitably formed spring is likewise appropriate as spring element 13 within the scope of the invention.

If the pivotal component 1 is now to be raised, compressed air is admitted to the hoses 9, which exert pressure on the plates 14 and corresponding forces on the bearing surface, which over the distance to the hinged joint 17 produce a torque, which raises the pivotal component 1. The spring element 13 acts in opposition to this torque, which must attain a certain minimum pressure in order to raise the pivotal component 1; furthermore sufficient restoring torque is also available for lowering the pivotal component 1.

In order that the pivotal component 1 can be held in a specific position without the hoses 9 having to remain pressurized, a locking device 12 is provided.

In this second embodiment the structural element 5 and the pivotal component 1 are in the extended position with the hoses 9 evacuated. In the first exemplary embodiment according to FIG. 1, on the other hand, the extended position is only attained with hoses 9 full.

FIG. 3 shows a detailed view of a second locking device 12 designed as ratchet 19. Mechanical details, within the grasp of any person skilled in the art, are omitted from FIGS. 3, 4.

The ratchet 19 is arranged on the plate 14, which is fixed to the structural element 5, so that under the pressure of a spring 20 the ratchet is displaced by a small distance to the right—in FIG. 3—until a disk 21 presses against the last aforementioned plate 14. The disk 21 is seated on a bar 22, which is connected by one end to the ratchet 19, and with the other end is capable of actuating a control valve 23.

Attached to the plate 14, which is connected to the pivotal component 1, is a catch device 24 engaging with the ratchet 19.

In the embodiment of a third locking device 12 as friction brake 25 according to FIG. 4, the ratchet 19 is merely replaced by a segment of a brake disk 26, and the catch device 24 by a second brake device 27. The arrangement and function of the other elements remain unchanged. Both the catch device 24 and the second brake device 27 are actuated by pneumatic actuators (not shown).

FIG. 5 shows an arrangement of control valves, which is suitable for controlling the pneumatic pivot devices according to the exemplary embodiments in FIGS. 1, 3 and 4. A first valve 30 and a second valve 31 are jointly actuated in order to raise the pivotal component 1—or the footrest. For joint actuation, the valves 30, 31 are mechanically or pneumatically connected so that only a single element, such as a first control key 42 need be pressed in order to do this. The system operating pressure is delivered to both valves 30, 31 by lines 32. The valves 30, 31 and also a succeeding third valve 33 are purely On/Off valves. The first valve 30 admits compressed air to the hoses 9, thereby raising the pivotal component 1. This simultaneously relieves the catch device 24. The second valve 31 admits compressed air to the control valve 23 on the ratchet 19, which in turn now operates the catch device 24 and draws back the catch. When the first valve 30 is opened, a fourth valve 34, which is normally open (NO), is closed by pneumatic or mechanical means. This latter valve obtains the controlling compressed air from the hoses 9 via a line 35.

When the valves 30, 31 are now released, the compressed air supply both to the hoses 9 via a line 36, and to the control valve 23 via a line 37 ceases; at the same time the fourth valve 34 reverts to the normal open position. The catch device thereby (valve 31) engages in the ratchet 19, and the compressed air supply (valve 30) to the hoses 9 ceases. In order that these are evacuated only slowly, a first siphon 38 is connected to the fourth valve 34 on the outlet side. The siphon opens automatically at a first predetermined pressure and remains open until a second predetermined pressure, which may also be zero, is reached. In the case of the siphon 38, "pressure" is taken to mean the differential pressure between its inlet (line 35) and its outlet, which opens into an air outlet line 39.

To lower the pivotal component 1 or the footrest 1, the valves 31, 33 are actuated simultaneously. Here too, the valves 31, 33 are mechanically or pneumatically connected so that only a single second control key 43 has to be pressed in order to actuate them. The third valve 33—like the first valve 30—opens the compressed air inlet to the hoses 9 via the line 36. The pivotal component 1 is thereby raised to such a degree that the catch device 24 is relieved and can be drawn back. A further fifth valve 40 is connected by mechanical or pneumatic means to the third valve 33, which is normal closed (NC), and is therefore also opened by the actuation of the third valve 33. The fifth valve 40 is connected to a second siphon 41, which opens at a first predetermined pressure and closes again at a second predetermined pressure, the latter of which may also be zero. The fifth valve 40 is also fed by the line 35 from the hoses 9: once the hoses 9 have reached the predetermined pressure for raising the pivotal component 1, the ratchet 19 is freed and the hoses 9 can be evacuated, until the valve 31 is released. This causes the catch device 24 to re-engage. Once the second siphon 41 then reaches the second predetermined pressure and closes again, the third valve 33 is reset by mechanical or pneumatic means. If a disk brake is used instead of the ratchet, the control according to FIG. 5 operates in precisely the same way.

Instead of curved ratchets or brake disk segments, elongated ratchets or brakes supported in suitable articulations can obviously also be used, as were shown, for example, with the first locking device in FIG. 1.

Although the first exemplary embodiment describes the invention with reference to a seat, especially an aircraft seat, its use is in no way restricted thereto. According to the invention, a set of hoses 9 with textile webs 4 is also capable of moving the head and/or foot part of a bed, such as a hospital bed, the head restraint of a seat or other adjusting devices.

FIG. 6 is a schematic representation of a bed 45, in particular a hospital bed. Hospital beds have a height adjustment for the entire bed surface on the one hand, and pivotal head and foot parts 46, 47 on the other. The adjustment facilities are generally powered by electric motors, which are actuated via a small panel easily operated by the patient. One of the objects of replacing means of adjustment powered by electric motors is to relieve electro-sensitive persons of the alternating electromagnetic fields inevitably associated with electric motors. Whilst replacement of the electromotive spindle drives with height adjustment by means of pneumatic cylinders, for example, may be regarded as an obvious measure in the context of this problem, and no reference is therefore made to this part in FIG. 6, the invention focuses on the head part 46 and foot part 47.

A raising device 49, preferably with pneumatic drive, is fixed to a supporting frame 48. The raising device 49 supports a middle part 50 of the bed 45 either directly or at any rate via a tilting device, which will not be discussed further here. A pivotal component 1 is pivoted at each of the two ends of the middle part 50, the components being designed as head part 46 at one end and foot part 47 at the other end. The pivot devices correspond to the second exemplary embodiment shown in FIG. 2 and here are only represented schematically.

In order that the head part 46 and the foot part 47 will not begin to oscillate uncomfortably under the movements of a person lying in the bed, locking devices are of particular importance here. In order to make things as easy and comfortable as possible for the patient lying in the bed, one button each must suffice for the upwards and downwards movement of the head part and the foot part. Among other things, the valve system presented in FIG. 5 meets precisely these requirements.

A further example of an application is shown in FIGS. 7*a, b*. This relates to a flap-like pivotal component 16, which is actuated by a plurality of hoses 9. Such a pivotal component 16 may be a door 52, a cover or an actuator connected to other elements. FIGS. 7*a, b* relates, for example, to a door 52. The pivotal component 16 is pivotally supported in a hinged joint 53 and, as shown in the detailed drawing FIG.

7*b*, is closed or held in the closed position by a schematically represented recovery spring 54 when the hoses 9 are unpressurized.

If compressed air is admitted, the hoses 9 press against a structural element 5—for example the door frame—and against a plate 14 on the pivotal component 1. Since the [lacunae] of the hoses 9 acts on the pivotal component 1 against the force of the recovery spring 54, the opening angle of the pivotal component 1 varies as a function of the air pressure in the hoses 9. If the pivotal component 1 is swivelled fully outwards, it strikes a shock absorber 55, for example.

FIG. 8 shows a further development according to the invention of the exemplary embodiment according to FIGS. 7*a, b*. The pivotal component 1 can here also be swivelled through an angle of about 90°. Instead of the hoses 9 interacting with a recovery spring 54, a second set of hoses 9 is here inserted, which are capable of swivelling the pivotal component 1 in the opposite direction.

FIG. 9 is a representation of an extension of the exemplary embodiment according to FIG. 8. Here the swivel range of the pivotal component 16 is designed for an angle >90°. Suitable mechanical measures can extend this swivel range to >180°. The textile webs 4 are extremely important, especially in the case of such large swivel angles, in order to prevent the hoses 9 from migrating and hence to guarantee the functioning of the pivot device.

The idea of the invention here obviously also encompasses the incorporation of a spring element (not shown)—or even two of these—, which returns the pivotal component 1 to a preselected angle when the hoses 9 are in an unpressurized state.

For the examples of applications shown in FIG. 7 to 9 it may be advantageous to also provide a locking device. This allows the flaps and doors to be fixed in any position. Control can also be achieved by means of the valve system shown in FIG. 5. For the example of an application in FIG. 9, the valve system in FIG. 5 requires slight adaptation, which will not be explained further here, since in order to swivel the pivotal component 1, the loading of one set of hoses 9 of necessity involves the relieving of the other set.

Bending joints of metal, plastics or other suitable materials may obviously also take the place of conventional hinged joints 2, 17, 53. Such a metal bending joint may also at the same time act or be used as spring element 20 or recovery spring 54. In order to take account of these circumstances, the term joint may here stand for all types of joints that can be used here.

According to the invention the textile webs can also be replaced by other materials and workpieces that can be subjected to tensile load. For example, a perforated aluminium plate may fulfil the same requirements as a textile web. Feasible replacements for a textile web 4 also include two or more cables, which are fixed to a rod leading along a hose 9. The term web will here be used for all these types of solutions.

The invention claimed is:

1. A pneumatically actuated pivot device for a component capable of pivoting about a joint and fixed to a structural element, the pneumatically active part comprising:

a set of airtight hoses with valves, the airtight hoses being arranged between parts which belong to the structural element or to a pivotal component;

wherein the hoses when pressurized, introduce torques into plates;

wherein the hoses are connected to at least one web, wherein the at least one web is fixed over its entire length close to the joint causing the hoses to fill only a curved part of a volume of a circular segment with an opening angle $\alpha$ and with the hinged joint at an apex, such that the volume to be pressurized can be minimized;

wherein the pneumatically actuated pivot device further includes a locking device with which the hoses unpressurized allow a torque acting on the pivotal component to be transmitted directly to the structural element; and wherein the pneumatically actuated pivot device further includes a valve system, wherein the valve system connects the locking device and the set of hoses in a way such that pressure is admitted to the hoses only when the pivotal component is being moved.

2. A pneumatically actuated pivot device according to claim 1, wherein the hoses are airtight coated hoses of textile material.

3. A pneumatically actuated pivot device according to claim 1, wherein the hoses are constructed from a textile casing and an airtight bag of elastic plastic material inserted into the casing.

4. A pneumatically actuated pivot device according to claim 3, wherein the pivotal component is connected to the structural element by a spring element such that the torque which the spring element exerts on the pivotal component counteracts the torque exerted by the hoses.

5. A pneumatically actuated pivot device according to claim 3, wherein at least one further set of hoses is provided and arranged so that the torque which they exert on the pivotal component counteracts the torque which the first set of hoses exerts on the pivotal component.

6. A pneumatically actuated pivot device according to claim 1, further comprising:

a valve control, wherein the valve control is equipped with two control keys which control the hoses and pneumatic actuators of the locking device such that by operating a first control key for swivelling the pivotal component out under load, compressed air is first admitted to the set of hoses until the locking device is relieved;

wherein the pressure in the set of hoses is then increased further until the first control key is released;

wherein upon releasing the first control key, the locking device is reactivated so that the pivotal component and the structural element are again firmly connected to one another and the set of hoses is evacuated;

wherein a second control key is adapted to run the pivotal component back under load;

wherein compressed air is first admitted to the set of hoses until the locking device is relieved;

wherein the pressure in the set of hoses is then reduced until the second control key is released; and wherein upon releasing the second control key, the locking device is reactivated so that the pivotal component and the structural element are again firmly connected to one another and the set of hoses is evacuated.

7. A pneumatically actuated pivot device according to claim 6, further comprising:

a friction brake connected to the structural element via a rod;

a second brake device connected to the pivotal component; and the second brake device of the friction brake is capable of acting on a brake disk and can be actuated by pneumatic actuators in such a way that with the hoses unpressurized, torque acting on the pivotal component is transmitted via the brake disk and the second brake device to the structural element.

8. A pneumatically actuated pivot device according to claim 6, wherein the locking device 12 further comprises:

a bar 8 articulated on the pivotal component;

wherein the bar 8 runs through a friction brake in the form of a first brake device; and wherein the first brake device is pivotally supported on an arm fixed to the structural element.

9. A pneumatically actuated pivot device according to claim 1, wherein the locking device further comprises:

a ratchet connected to the structural element;

a catch device connected to the pivotal component;

wherein the catch device is adapted to engage in the ratchet and be actuated by pneumatic actuators in a way such that when the hoses are unpressurized, a torque acting on the pivotal component is transmitted via the ratchet and the catch device to the structural element.

10. A pneumatically actuated pivot device according to claim 9, wherein the ratchet is connected to the structural element via a rod;

wherein the rod is moveable in relation to the structural element over a small travel, the movement in relation to the structural element being limited by a disk;

a spring is provided, wherein the spring is adapted to press the ratchet against the structural element; and a first control valve is provided, wherein the first control valve is actuated by the rod.

11. A pneumatically actuated pivot device according to claim 1, wherein the pivotal component is a flap-like element.

12. A pneumatically actuated pivot device according to claim 11, wherein the pivotal component is designed as a head part of a bed, wherein the structural element is formed by a middle part of the bed.

13. A pneumatically actuated pivot device according to claim 11, wherein the pivotal component is designed as a foot part of a bed, wherein the structural element is formed by a middle part of the bed.

14. A pneumatically actuated pivot device according to claim 11, wherein the pivotal component is designed as a footrest of a seat, wherein the structural element is being formed at least indirectly by a surface of the seat.

15. A pneumatically actuated pivot device according to claim 11, wherein the pivotal component is designed as a door.

* * * * *

UNITED STATES PATENT AND TRADEMARK OFFICE

CERTIFICATE OF CORRECTION

PATENT NO. : 7,017,468 B2
APPLICATION NO. : 10/487328
DATED : March 28, 2006
INVENTOR(S) : Josef Steffen It is certified that error appears in the above-identified patent and that said Letters Patent is hereby corrected as shown below:

Title page,
Item [74], *Attorney, Agent, or Firm*, replace "Jenken" with -- Jenkens --.

Column 8,
Line 19, delete "being".

Signed and Sealed this

Fourth Day of July, 2006

JON W. DUDAS
*Director of the United States Patent and Trademark Office*